US005203842A

United States Patent [19]

Mark et al.

[11] Patent Number: 5,203,842

[45] Date of Patent: Apr. 20, 1993

[54] NOZZLE DEVICE FOR A HIGH-PRESSURE LIQUID JET

[75] Inventors: Edi Mark, Wäseliweg, CH-9475 Sevelen; Hartmut Brenner, Staad, both of Switzerland

[73] Assignee: Edi Mark, Sevelen, Switzerland

[21] Appl. No.: 598,649

[22] PCT Filed: Mar. 12, 1990

[86] PCT No.: PCT/CH90/00061

§ 371 Date: Nov. 9, 1990

§ 102(e) Date: Nov. 9, 1990

[87] PCT Pub. No.: WO90/11134

PCT Pub. Date: Oct. 4, 1990

[30] Foreign Application Priority Data

Mar. 17, 1989 [CH] Switzerland ..... 991/89

[51] Int. Cl.[5] ..... B05B 3/02

[52] U.S. Cl. ..... 239/227; 239/263.1; 239/263.3; 239/264

[58] Field of Search ..... 239/752, 263.1, 263.3, 239/264, 227; 175/65, 393, 424; 299/17; 51/439, 429

[56] References Cited

U.S. PATENT DOCUMENTS

| | | | |
|---|---|---|---|
| 3,460,988 | 8/1969 | Kennedy, Jr. et al. | 239/227 |
| 3,625,425 | 12/1971 | Robinson | 239/227 |
| 3,799,445 | 3/1974 | Marino | 239/227 |
| 4,036,437 | 7/1977 | Dreher . | |
| 4,306,627 | 12/1981 | Cheung et al. | 299/17 |
| 4,852,595 | 8/1989 | Baier et al. | 239/263.1 |
| 4,854,091 | 8/1989 | Hashish et al. | 51/439 |
| 4,920,997 | 5/1990 | Vetter et al. | 239/752 |
| 4,967,962 | 11/1990 | Kawaguchi et al. | 239/263.1 |
| 5,037,672 | 8/1991 | Daussan et al. | 239/227 |

*Primary Examiner*—Andres Kashnikow
*Assistant Examiner*—Lesley D. Morris
*Attorney, Agent, or Firm*—Harold Gell

[57] ABSTRACT

A nozzle arrangement for a high pressure jet for use in a device for treating surfaces by removing material from, roughening or cleaning such surfaces comprises a nozzle having an elongate body which is rotatable about its longitudinal axis. A nozzle head inclined at an angle of approximately 30° to the longitudinal axis of the nozzle body communicates with the interior of the nozzle body and a high pressure pump is provided for generating a high pressure liquid jet to issue from the nozzle head. The nozzle head is maintained at a substantially constant distance from a planar surface to be treated and the nozzle body is reciprocated in partial rotations about its longitudinal axis in opposite directions to cause the high pressure jet issuing from the nozzle head to strike the surface to be treated with a recurring arc-shaped pivoting movement. The nozzle body has a toothed ring which is engaged by a toothed rack in order to impart partial rotations to the body and a further drive is provided by means of which further reciprocation of the nozzle body can be imposed on said partial rotational movement.

16 Claims, 3 Drawing Sheets

NOZZLE DEVICE FOR A HIGH-PRESSURE LIQUID JET

The present invention relates to a nozzle arrangement for a high pressure liquid jet for use in a device by means of which materials can be removed, roughened or cleaned.

Such devices are used, in particular, in building construction and mining and in tunnelling. They are employed, for example, in renovation of concrete constructions. Damage is increasingly being observed in concrete constructions such as bridges and viaducts built in earlier years, which require renovation as, otherwise, the damage might even necessitate demolition and reconstruction of the respective construction. For this purpose the defective outer layer of concrete has to be removed and the iron reinforcement possibly exposed and cleared of rust to enable a new layer of concrete or a new coating of concrete to be applied.

Break-out hammers were initially used to remove the defective concrete. The iron reinforcement was then cleared of rust by sandblasting. This mode of operation has some serious disadvantages. On the one hand, the labour costs are very high. On the other hand, the result achieved by carrying out this method of breaking out the defective concrete is qualitatively inadequate, particularly since damage to the iron reinforcement and the solid concrete is almost unavoidable owing to the impacts and vibrations.

There have therefore been attempts to find a solution to this problem in that removal has been effected using a water jet directed at high pressure and high speed onto the concrete surface. Machinery has been developed for this purpose which moves along slowly on wheels, has, on its front face, a water nozzle reciprocating on a rail transversely to the direction of travel and is remotely controlled for safety reasons.

The water nozzle stops briefly at each end of its transverse movement before moving back again. In the course of this transverse movement, the water nozzle is also set into an oscillating movement transversely thereto. Owing to the very great force of the water jet, normal holes are repeatedly shot into the concrete owing to the technically induced brief stoppage of the water nozzle at the end of the transverse movement. The above-mentioned oscillation of the nozzle also leads to uneven removal as the nozzle head is consequently not constantly at the same distance from the material surface to be treated. The distance is smaller in the centre of the oscillating movement than at the two ends. Owing to these disadvantages, it is often impossible satisfactorily to apply the new concrete layer to close any holes which may be present. It is therefore anticipated that fresh damage will occur in the foreseeable future to concrete constructions renovated in this way. For these reasons, it was usually necessary to adapt this mode of operation.

Accordingly it is an object of the invention to provide a nozzle arrangement which does not have the disadvantages of the known nozzle arrangements.

According to the invention, there is provided a nozzle arrangement for a high pressure liquid jet for use in a device for treating surfaces by removing material from, roughening or cleaning said surfaces; said arrangement comprising a nozzle having an elongate nozzle body having a longitudinal axis, the nozzle body being rotatably mounted about its longitudinal axis; a nozzle head inclined at an angle of approximately 30° to the longitudinal axis of the nozzle body and communicating with the interior of said nozzle body; means for maintaining the nozzle head at a substantially constant distance from a planar surface to be treated; means for generating a high pressure liquid jet to issue from the nozzle head and means for reciprocating the nozzle body in partial rotations about its longitudinal axis in opposite directions to cause the high pressure liquid jet issuing from the nozzle head to strike the surface to be treated with a recurring arc-shaped pivoting movement.

Preferably, means are provided for superimposing on the said partial rotations of the nozzle body, further rotations of said nozzle body.

The nozzle body is preferably provided with a contact face, which may take the form of a toothed ring encircling the nozzle body, by means of which the nozzle body can be set into a partial rotational movement and into rotation by engagement with, for example, a toothed rack.

Extremely uniform removal is guaranteed since the nozzle head is invariably kept at an equal distance from the material surface to be treated and the high pressure liquid jet never stops. The iron reinforcement can also be completely exposed and de-rusted owing to the nozzle arrangement according to the invention.

An embodiment of the subject of the invention is described hereinafter with reference to the drawings.

Figure 1:
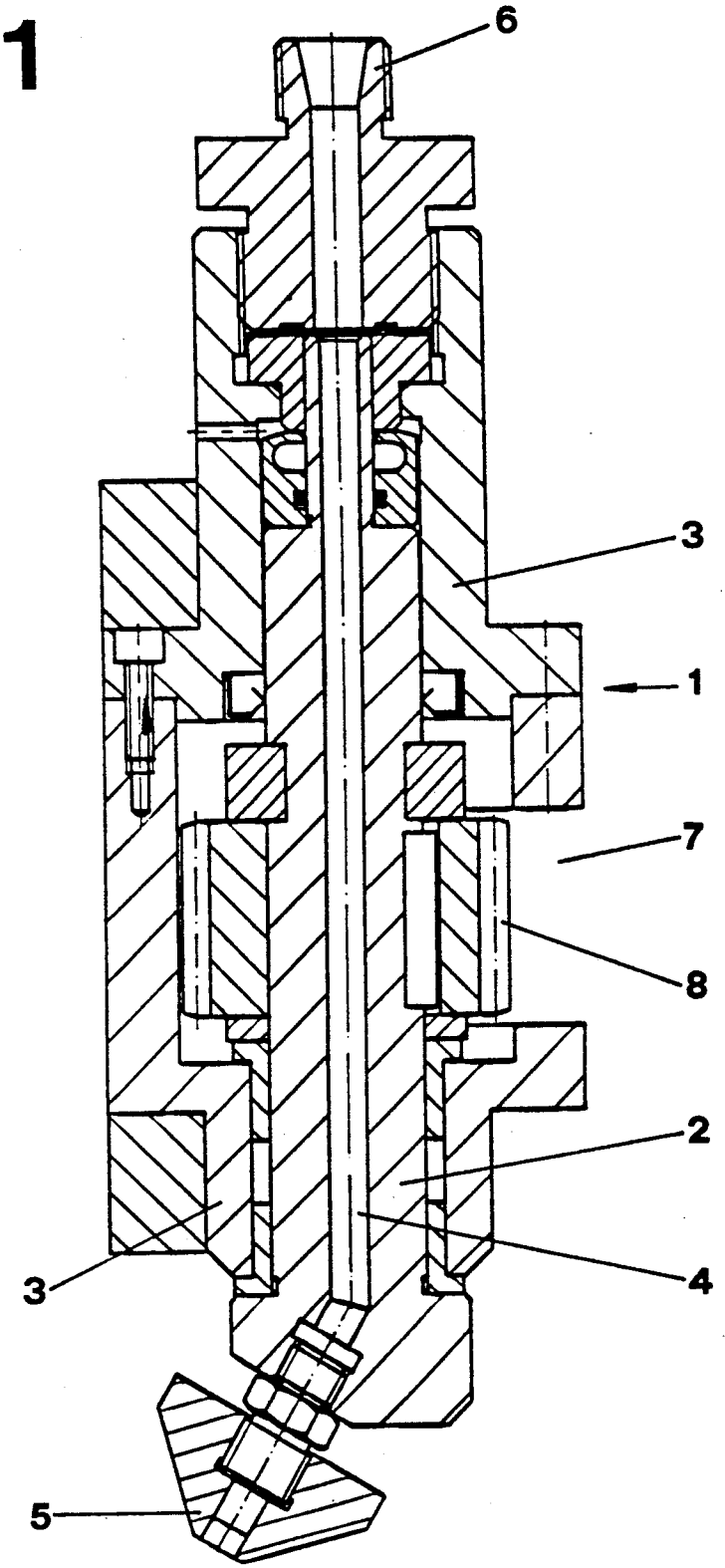
FIG. 1 shows a sectional view of the nozzle.

The nozzle 1 consists of a nozzle body 2 which is rotatably mounted about its longitudinal axis in a housing 3. The flow duct 4 is angled through 30° in the region of the nozzle head 5. At the connection 6, the nozzle 1 can be attached to a conduit coming from a high pressure pump. The housing 3 has a lateral opening 7 through which a toothed ring 8 encircling the nozzle body 2 is accessible from the exterior.

Figure 2:
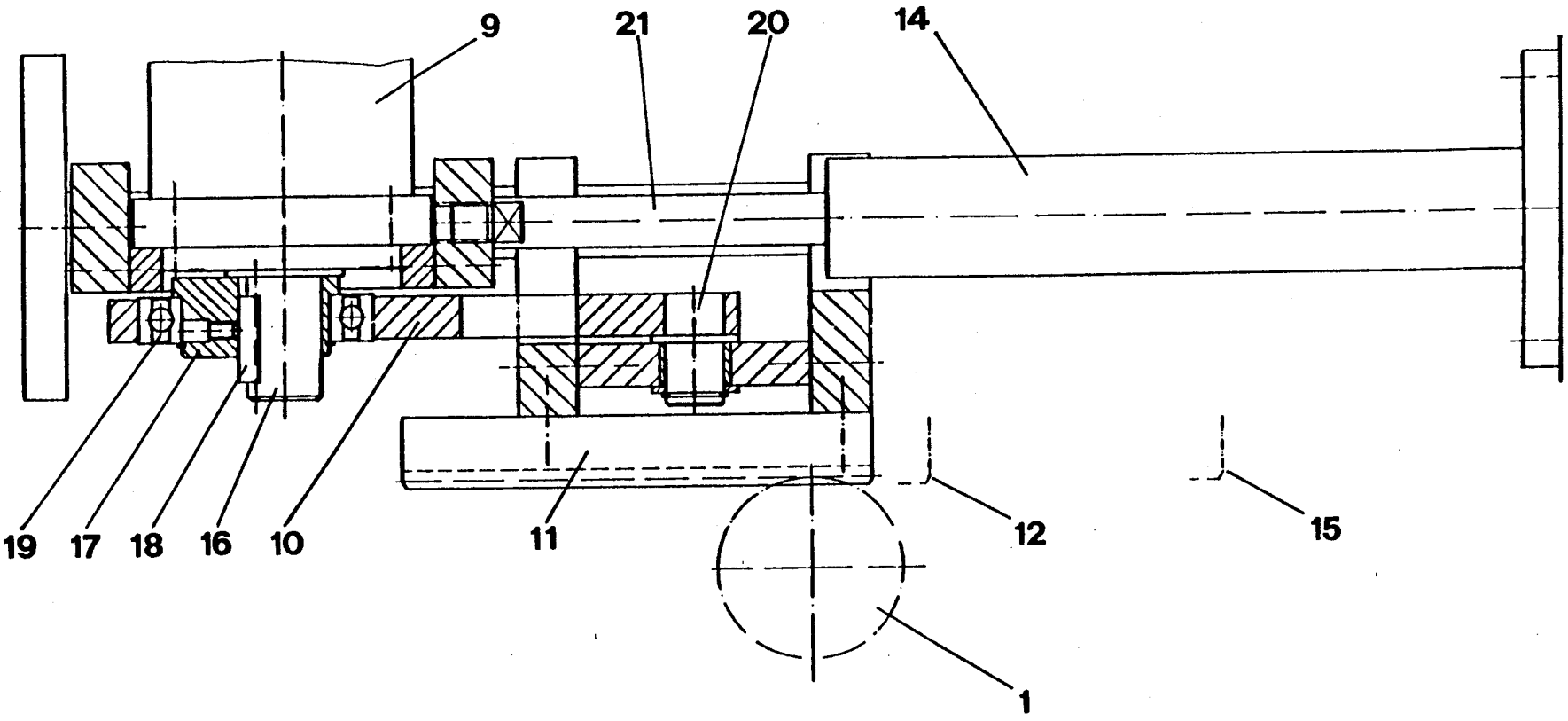
FIG. 2 shows a plan view of the drive of the nozzle, partly in section.
Figure 3:
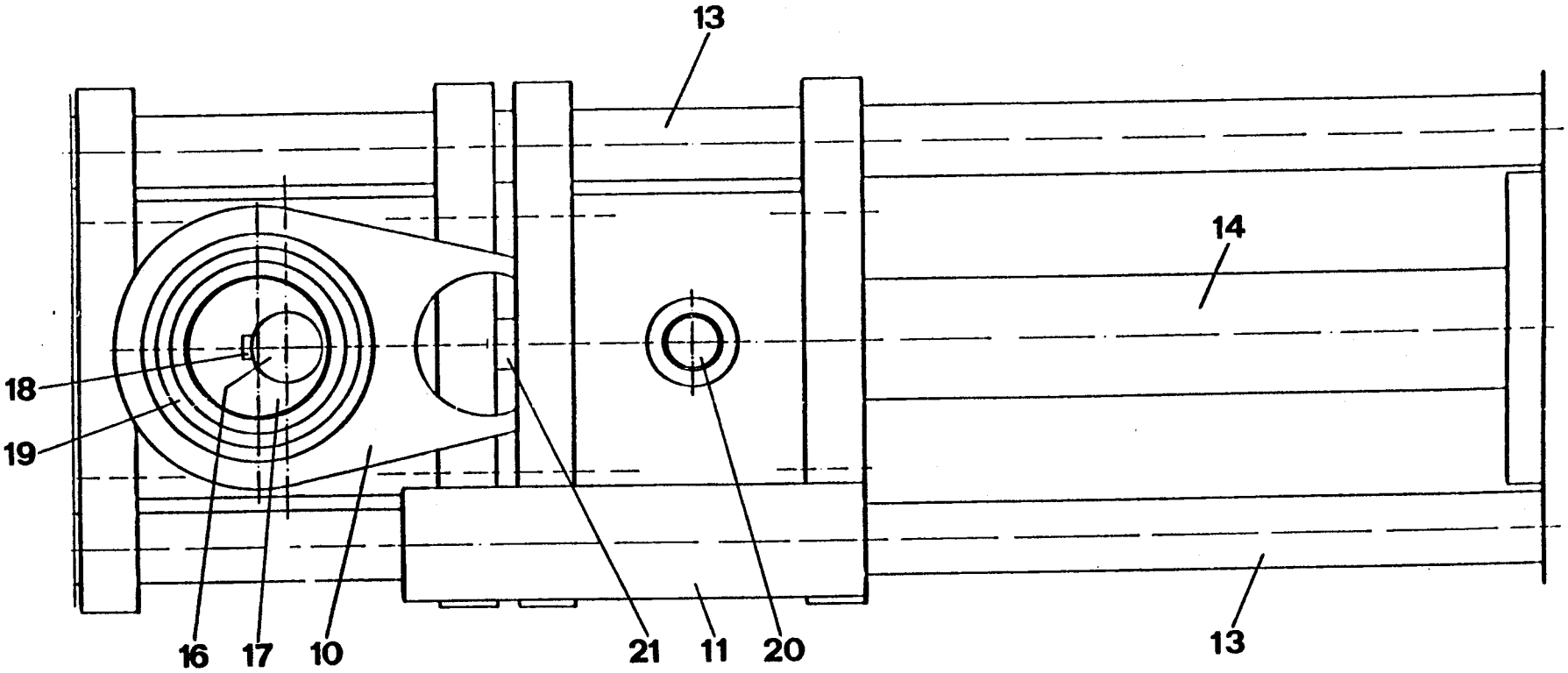
FIG. 3 shows a side view of the drive of the nozzle in accordance with FIG. 2.

The nozzle 1 is driven by a motor 9, for example an electric motor. The motor 9 has a drive shaft 16 and an eccentric cam 17 is keyed to the drive shaft by a key 18. A cam lever 10 is mounted on the eccentric cam 17 by means of bearings 19 such that the cam 17 is freely rotatable with respect to the lever 10. The cam lever 10 is connected by a shaft 20 to a rack 11. The arrangement is such that rotation of the drive shaft 16 by the motor 9 causes the cam 17 to rotate in an eccentric manner which imparts a reciprocating movement to the cam lever 10. This reciprocating movement is transmitted to the rack 11 which reciprocates between the position shown in full lines in FIG. 2 and the position indicated in broken lines at 12 in FIG. 2.

The rack 11 engages with the toothed ring 8 at the periphery of the nozzle body 2 and, owing to its reciprocating movements, sets the nozzle body into a recurring partial rotational movement. Owing to the angled flow duct 4 at the nozzle head 5, the issuing liquid jet performs a recurring arc-shaped pivoting movement.

The drive consisting essentially of the motor 9, the cam 17, the lever 10 and the rack 11 is displaceable as an entity along guide rails 13 and is connected to a piston 21 of a cylinder 14. The cylinder is arranged to move the piston 21 in a reciprocating manner and is effective to displace the rack 11 longitudinally between the position shown in full lines in FIG. 2 and the position indicated by the broken line 15 in FIG. 2. The longitudinal displacement of the rack 11 causes the nozzle 1 to rotate about its longitudinal axis while the rack continues performing its reciprocating movements imparted by the cam lever 10 and the nozzle 1 therefore continues performing its recurring rotational movements. As a result, the direction of the issuing liquid jet can be changed.

The nozzle arrangement described hereinbefore is intended, in particular, for incorporation into a suitable device for the removal of concrete. It is preferable to use water which is brought to a pressure of about 1,200 bar by a high pressure pump. The nozzle arrangement can be controlled in this device such that a predetermined concrete face is covered. For this purpose, the nozzle 1 is firstly moved in a straight line along one side of the rectangular concrete face to be treated, performing rapid arc-shaped pivoting movements. The high pressure liquid jet striking the concrete face describes. arcs, so to speak, which are joined to each other at one end to form a zig-zag line. Once the nozzle 1 has arrived-at the end of said side, it is controlled such that it pivots over a line extending parallel to the first line and moving back in the opposite direction. This is repeated until the entire concrete face has been covered in loops.

The described rotation of the nozzle 1 by means of the cylinder 14 acting indirectly on the rack 11 serves to rotate the nozzle 1 through 180° while it travels round a curve at the ends of the loops. The nozzle 1 therefore travels line by line.

This mode of operation permitted by the nozzle arrangement according to the invention ensures that the high pressure liquid jet never stops. The risk of holes, which are difficult to close, being formed in the concrete is therefore avoided. The nozzle 1 also moves at an ever constant distance from the concrete face and therefore guarantees uniform removal. As the liquid jet is also bent through 30°, it can extend beneath the iron reinforcement and can expose it completely and clear it of remains of concrete and rust.

We claim:

1. A nozzle arrangement for a high pressure liquid jet for use in a device for treating surfaces by removing material from, roughening or cleaning said surfaces; said arrangement comprising: a nozzle including a nozzle head and an elongated nozzle body said nozzle being rotatably mounted about the longitudinal axis of said elongated nozzle body;

said nozzle head inclined at an angle of approximately 30° to said longitudinal axis of said longitudinal nozzle body and communicating with the interior of said longitudinal nozzle body;

means for maintaining said nozzle head at a substantially constant distance from a planar surface to be treated;

means for generating a high pressure liquid jet to issue from said nozzle head; and means for reciprocating said elongated nozzle body in partial rotations about said longitudinal axis of said elongated nozzle body to cause the high pressure liquid jet issuing from said nozzle head to strike the surface to be treated with a recurring arc-shaped pattern.

2. A nozzle arrangement according to claim 1, wherein means are provided for superimposing on said partial rotations of said elongated nozzle body, linear reciprocations of said elongated nozzle body along a path perpendicular to said elongated nozzle body longitudinal axis.

3. A nozzle arrangement according to claim 2, characterized in that said elongated nozzle body is rotatably mounted in a housing.

4. A nozzle arrangement according to claim 2, characterized in that said elongated nozzle body is provided with a contact face by which said elongated nozzle body can be set into a rotational reciprocating movement.

5. A nozzle arrangement according to claim 4, characterized in that said contact face is a toothed ring encircling said elongated nozzle body.

6. A nozzle arrangement according to claim 5, including a rack acting upon said toothed ring of said elongated nozzle body to set said elongated nozzle body into said partial rotational reciprocating movement.

7. A nozzle arrangement according to claim 6, comprising:

a motor;

a cam which oscillates round the axis of rotation of said motor for producing a reciprocating movement;

said rack (11) coupled to said cam for driving said elongated nozzle body in said recurring partial rotational movement.

8. A nozzle arrangement according to claim 7, comprising:

a linear drive including a piston and cylinder; said rack connected to said piston of said linear drive whereby said elongated nozzle body is set into a linear reciprocation superimposed on said partial rotational movement.

9. A nozzle arrangement according to claim 8, wherein the linear drive comprises a piston-cylinder unit, the piston being connected to the rack.

10. A nozzle assembly, comprising:

an elongated nozzle body including an internal fluid path;

a nozzle head connected to said elongated nozzle body and providing an outlet for said fluid path;

said nozzle head inclined at an angle to the longitudinal axis of said elongated nozzle body;

means for driving said elongated nozzle body and said nozzle head in a reciprocating rotational movement about said longitudinal axis of said elongated nozzle body; and means for driving said elongated nozzle body and said nozzle head in a reciprocating linear movement.

11. A nozzle assembly as defined in claim 10 wherein said means for driving said nozzle head and said elongated nozzle body in a reciprocating rotational movement comprises:

an external gear encircling at least a portion of said elongated nozzle body;

a rack including teeth engaging said external gear; and means for reciprocating said rack for rotating said elongated nozzle body to generate said reciprocating rotational movement.

12. A nozzle assembly as defined in claim 11 wherein said means for driving said elongated nozzle body and said nozzle head in a reciprocating linear movement comprises:

a housing for supporting said elongated nozzle body and allowing rotation of said elongated nozzle body about said elongated nozzle body's longitudinal axis;

guide means for supporting said housing and allowing reciprocation of said housing along a linear path; and said means for reciprocating said rack reciprocates said housing along said linear path.

13. A nozzle as defined in claim 12 wherein said means for reciprocating said rack and said housing comprises:

a rotary motor;

a cam rotated by said motor; and a cam interactive means including a surface surrounding said cam whereby the rotation of said cam causes reciprocation of said interactive means.

14. A nozzle assembly as defined in claim 13 wherein said rack is driven by said interactive means by a mechanical coupling therebetween.

15. A nozzle assembly as defined in claim 14 wherein said means for reciprocating said housing comprises a linear drive activated by said interactive means.

16. A nozzle arrangement according to claim 15, wherein said linear drive comprises a piston and cylinder unit, said piston being connected to said rack.

* * * * *